United States Patent [19]

Areaux

[11] Patent Number: 4,872,907

[45] Date of Patent: Oct. 10, 1989

[54] METAL CHIP FURNACE CHARGE APPARATUS AND METHOD

[75] Inventor: Larry D. Areaux, Nathrop, Colo.

[73] Assignee: Pre-Melt Systems, Inc., Kalamazoo, Mich.

[21] Appl. No.: 213,365

[22] Filed: Jun. 30, 1988

[51] Int. Cl.[4] ..... C21B 9/16; F27B 14/16

[52] U.S. Cl. ..... 75/65 R; 75/68 R; 75/72; 75/256; 266/88; 266/160; 266/200; 266/900; 266/901

[58] Field of Search ..... 75/65 R, 68 R, 72, 256, 75/44 R, 44 S; 266/160, 200, 900, 901, 88

[56] References Cited

U.S. PATENT DOCUMENTS 4,702,768 10/1987 Areaux et al. ..... 75/65 R

*Primary Examiner*—Melvyn J. Andrews

*Attorney, Agent, or Firm*—Gordon W. Hueschen

[57] ABSTRACT

Apparatus and method for charging metal chips into a molten bath of the metal from which the chips are formed, comprising a compacting extruder and a delivery conduit which is resistant to the mass of molten metal and which is pivotable to dip into the molten metal bath when chips are being charged thereinto and out of contact with the bath when charging is to be discontinued, are disclosed. The chips are forced through the delivery conduit in the form of a compacted or densified mass preferably having a density between about 30 and 60 percent of the density of the solid metal and preferably between about 55 and 80 pounds per cubic foot. Feed is continued while the delivery conduit is in the molten metal bath and until it is removed therefrom to prevent entry of molten metal into the delivery conduit. The method is preferably conducted on a continuous basis and various sensors with appropriate wiring may be employed for safety and for making the method substantially automatic in operation.

49 Claims, 4 Drawing Sheets

METAL CHIP FURNACE CHARGE APPARATUS AND METHOD

BACKGROUND OF THE INVENTION

1. Field of the Invention

Utilization of metal chips, especially scrap metal chips, particularly brass and aluminum. Introduction of said metal chips into a molten mass of metal of which they are formed and below the surface thereof. Maintaining a densified mass of compacted chips at an optimum density and maintaining the rate of chip introduction into the molten metal mass at an optimum level and apparatus for so doing.

2. Prior Art

The situation has been fully reviewed in my prior U.S. Pat. No. 4,702,768, upon which the present method and apparatus are improvements. Reference is made to that U.S. patent, issued Oct. 27, 1987, and the disclosure thereof is incorporated herein by reference as fully as though it were set forth herein. It is a part of the prior art relevant to the present invention and the most relevant prior art of which I am aware.

In my prior patent, a method of compacting and extruding metal chips into the form of a solid stripform or rope, from a briquetter or compacting extruder or the like, for the convenient and controlled introduction thereof into a mass of molten metal of which the chips were formed at a point below the surface thereof, and apparatus for so doing, was disclosed. The object was to reduce undesirable oxidation of the chips and of the mass of molten metal into which introduced, and to obtain more efficient and economical control over the procedure of rapidly melting the starting chips into a mass of molten metal in a reverberatory furnace or the like, a paramount objective being the provision of a more satisfactory method whereby metal chips, especially scrap metal chips, could be reintroduced into the stream of commerce in the form of new metal.

Although the method and apparatus of my prior patent went far toward alleviating the problems previously existing in the art, it has now been found that still additional improvements and advantages can be effected. Such improvements in the method and in the apparatus are the subject matter of the present patent application.

OBJECTS OF THE INVENTION

It is an object of the present invention to provide an improved method for the introduction of starting metal chips into a mass of molten metal of which they are formed, and apparatus for so doing. Another object is the provision of such method and apparatus wherein the chips are not introduced into the molten metal mass in the form of a solid metal rope or chain of briquettes or the like, but rather in the form of a compacted-extruded densified mass of chips, preferably having a predetermined weight and a predetermined density, both by way of pounds per cubic foot and by way of percentage of the density of the solid metal itself. An additional object is the provision of such a method and apparatus for conducting the same wherein compacted metal chips are forced into and along a suitable delivery conduit in the form of a compacted or densified mass which substantially fills the delivery conduit, and preferably having the aforementioned characteristics, until the mass of compacted chips bursts forth from the exit end or port of the delivery conduit below the surface of the mass of molten metal in the form of dissipated or dissociated chips, which readily and substantially immediately melt into the mass of molten metal below the surface thereof without loss of substantial amounts of metal by virtue of oxidation during the process. A still further object of the invention is the provision of such a method involving relatively economical compactor-extruder means and wherein the compacted and extruded chips proceed in the form of a densified mass into and along a delivery conduit until they exit into the mass of molten metal beneath the surface thereof, wherein a sufficient pressure is maintained upon the mass of chips within the delivery conduit at all times sufficient to prevent substantial entry of the mass of molten metal into the delivery conduit, and such a method which may be conducted on a continuous, semi-continuous, or batchwise basis, as desired, and wherein the delivery conduit or the entire chip-charge unit of the invention may be lowered into or elevated out of contact with the mass of molten metal, preferably but not necessarily by pivoting the same. A still further object of the invention is to provision of such a method and apparatus for the practice thereof wherein the pressure upon and feed of compacted-extruded chips in the form of the densified mass is maintained in the delivery conduit until the delivery conduit is elevated out of contact with the mass of molten metal. Still an additional object of the invention is the provision of such a method and apparatus for the practice thereof wherein numerous sensors with associated circuitry or wiring are provided for purposes of safety and for making the method substantially automatic in operation, if desired. Still further objects will become apparent hereinafter and still additional objects will be apparent to one skilled in the art to which this invention pertains.

SUMMARY OF THE INVENTION

The invention, then, comprises the following aspects, inter alia, alone or in combination:

A method for the industrial utilization of metal chips which involves the introduction of said metal chips into a mass of molten metal of which said chips are formed, comprising the steps of:

providing a delivery conduit of a material which is resistant to the mass of molten metal, under the temperature and other conditions present therein, compacting and extruding said metal chips into said delivery conduit in the form of a densified mass, creating a pressure upon the mass of chips in the delivery conduit, causing the mass of chips in the delivery conduit to substantially fill said delivery conduit and to move along said delivery conduit, causing said delivery conduit to dip into said mass of molten metal so as to provide a point of introduction below the surface thereof, causing the mass of chips within the delivery conduit to exit from said delivery conduit directly into said mass of molten metal at said point of introduction below the surface thereof, and maintaining a pressure upon the mass of chips within the delivery conduit sufficient to prevent substantial entry of the mass of molten metal into said delivery conduit; such a method which is conducted on a continuous basis; such a method which is conducted on a semicontinuous or batchwise basis; such a method wherein said delivery conduit is elevated out of said mass of molten metal when it is desired to discontinue the introduction of chips thereinto; such a method wherein said delivery conduit is alternately dipped into and removed from said mass of molten metal; such a method comprising the step of alternately pivoting the delivery conduit to a position dipping into said mass of molten metal and to a position removed from said mass of molten metal; such a method wherein the process is carried out on a continuous basis until it is desired to discontinue introduction of the densified mass of chips into the molten mass of metal, whereupon said delivery conduit is elevated out of a position dipping into said mass of molten metal and the pressure upon the mass of chips in the delivery conduit is reduced or discontinued; such a method including the step of providing supply means for chips ahead of said compaction and extrusion steps and sensing the presence of starting chips in said supply means and discontinuing the introduction of the mass of chips into the molten mass of metal when the quantity of starting chips falls below a predetermined minimum; such a method wherein, as a part of said discontinuance, said delivery conduit is pivoted to a position removed from said mass of molten metal; such a method including the step of providing supply means ahead of said compaction and extrusion steps and sensing the presence of starting chips in said supply means and commencing the introduction of the densified mass of chips into the molten metal when the quantity of starting chips is above a predetermined minimum; such a method wherein, as a part of the discontinuance of said introduction, the delivery conduit is pivoted from a position dipping into said mass of molten metal to a position removed from said mass of molten metal; such a method wherein the chips are compacted to a point within the range of approximately 55 to 80 pounds per cubic foot during the extrusion process; such a method wherein the chips are compacted to approximately 65–70 pounds per cubic foot during the extrusion process; such a method wherein the density of the mass of chips within the delivery conduit is maintained between about 30 and 60 percent of the density of the solid metal; such a method wherein the density of the mass of chips within the delivery conduit is maintained between about 40 and 50 percent of the density of the solid metal; such a method wherein the density of the mass of chips within the delivery conduit is maintained at approximately 42 percent of the density of the solid metal; such a method wherein the starting material comprises aluminum chips and the bath of molten metal is molten aluminum; such a method wherein an inert gas is introduced into the delivery conduit along with the mass of chips for the displacement of oxygen therein; such a method wherein said delivery conduit is removed from the mass of molten metal before discontinuing feed of the densified mass of chips to said delivery conduit; and such a method including the step of sensing the presence of starting metal chips in supply means located ahead of said compaction and extrusion steps and discontinuing delivery of starting metal chips to said supply means when the quantity of metal chips therein exceeds a predetermined maximum.

Moreover, an apparatus for the introduction of metal chips into a mass of molten metal of which said chips are formed, the combination comprising:

compactor and extruder means for compaction and extrusion of compacted metal chips into a delivery conduit in the form of a densified mass, a delivery conduit of material resistant to the mass of molten metal under the temperature and other conditions present therein, wherein said delivery conduit has one open end for communicating with said mass of molten metal and an opposite open end in communication with said extruder means, means for providing a pressure upon the mass of chips within said delivery conduit, and for moving said mass of chips along said delivery conduit, and out of said one open end thereof and into said mass of molten metal when said delivery conduit is positioned so as to dip below the surface of said mass of molten metal; such a combination comprising a metal chip charge box for introduction of starting metal chips into said compactor and extruder means; such a combination including hopper means associated with said charge box for delivery of starting metal chips thereinto; such a combination comprising elevating and lowering means for lowering said delivery conduit into a position dipping into said mass of molten metal and elevating said delivery conduit into a position removed from said mass of molten metal; such a combination wherein the means operating both to extrude said chips in the form of a densified mass into said delivery conduit and to provide pressure upon the mass of chips in said delivery conduit is a compactor-extruder; such a combination wherein said compactor and extruder means is a screw-compacting extruder; such a combination including supply means for bringing said starting material chips to the compactor and extruder; such a combination including sensing means associated with said supply means for discontinuing feed of the mass of chips into said molten metal mass when the supply of starting metal chips falls below a predetermined minimum; such a combination including elevating means for elevating said delivery conduit out of said molten metal bath and wherein said sensing means is also associated with said elevating means; such a combination including metal chip supply means for bringing metal chips to the extruder and compactor and sensing means for discontinuing supply of metal chips when the quantity of starting metal chips in said supply means is above a predetermined maximum; such a combination including metal chip supply means for bringing metal chips to the extruder and compactor and pivot means and sensing means for pivoting said delivery conduit out of contact with said molten metal bath when the quantity of metal chips in said supply means falls below a predetermined minimum; such a combination including means for the introduction of an inert gas into said delivery conduit along with the compacted or densified mass of chips; such a combination including elevating and lowering means for elevating and lowering said delivery conduit into contact with and out of contact with said mass of molten metal and sensing means for sensing the supply of starting metal chips and initiating feed of chips to said compactor and extruder and into said delivery conduit when said supply of starting chips is above a predetermined minimum but for elevating said delivery conduit out of contact with said molten metal bath and discontinuing feed when said supply of starting metal chips falls below a predetermined minimum; such a combination comprising sensing means for sensing a minimum supply of starting metal chips located ahead of said compactor and extruder and for removing the delivery conduit from the molten metal bath when the supply of starting metal chips falls below such a minimum; and such a combination including means for pivoting said delivery conduit into and out of contact with said molten metal bath, and sensing means for pivoting said delivery conduit out of contact with said molten metal bath before discontinuing feed of starting metal chips to said compactor and extruder means, and means for sensing the minimum supply of starting chips below which feed is discontinued.

Further, an apparatus for the introduction of metal chips into a mass of molten metal of which said chips are formed, the combination comprising:

compactor and extruder means for compaction and extrusion of compacted metal chips into said delivery conduit in the form of a densified mass, a delivery conduit of material resistant to the mass of molten metal under the temperature and other conditions present therein, wherein said delivery conduit has one open end for communicating with said mass of molten metal and an opposite open end in communication with said extruder means, means for providing a pressure upon the mass of chips within said delivery conduit, and for moving said mass of chips along said delivery conduit, and out of said one open end thereof and into said mass of molten metal when said delivery conduit is positioned so as to dip below the surface of said mass of molten metal, and pivot means for pivoting said combination into a position in which said delivery conduit is dipping into said mass of molten metal and into a position wherein said delivery conduit is removed from said mass of molten mass; such a combination comprising a metal chip charge box for introduction of starting metal chips into said compactor and extruder means, and wherein said charge box pivots along with said combination; and such a combination including hopper means associated with said charge box for delivery of starting metal chips thereinto and wherein said hopper pivots along with said charge box.

Moreover, such a method including the step of coordinating the rate of feed of said compacted chips into said mass of molten metal with the temperature in said mass of molten metal at or near the point of introduction of said compacted metal chips thereinto and such a method wherein the rate of introduction of said compacted chips into said mass of molten metal is reduced or stopped when said temperature in said molten metal mass at or near said point of introduction falls below a predetermined temperature.

Additionally, such a combination comprising sensing means for sensing the temperature in a mass of molten metal and control means for coordinating the rate of exit of said compacted metal chips from said delivery conduit with the temperature sensed in said molten metal mass, and such a combination wherein said sensing means comprises a thermocouple.

Finally, such a combination comprising sensing means for sensing the temperature in a mass of molten metal and control means for removing said delivery conduit from or lowering said delivery conduit into said mass of molten metal depending upon the temperature sensed in said molten metal mass, and such a combination wherein said sensing means comprises a thermocouple.

GENERAL DESCRIPTION OF THE INVENTION

The invention comprises an improved method for the introduction of metal chips into a metal bath of which the chips are made, the said method enabling the employment of much more economic apparatus then previously utilizable, involving a compacting extruder with appropriate means for compacting and appropriate means for extruding, and a delivery conduit which is elevatable, retractable, or pivotal out of contact with a mass of molten metal and lowerable, extendable, or pivotable for dipping beneath the surface thereof and constructed of suitable material which is resistant to the temperature and other conditions existing in the said mass of molten metal. A unique aspect of the method of the invention is that the chips are not introduced into the mass of molten metal in the form of a solid chain of briquetted metal or a solid rope or the like, but rather in the form of a compacted mass which is preferably compacted to a density which is approximately 55 to 80 pounds per cubic foot, preferably approximately 65 to 70 pounds per cubic foot, and usually between about 30 and 60 percent of the density of the solid metal itself, preferably between about 40 and 50 percent of the density of the solid metal itself and, particularly for aluminum chips, with approximately 42 percent of the density of the solid metal appearing to be optimum. With such densities of the compacted chips, a densified mass is produced which can be made substantially to fill the delivery conduit and a sufficient pressure may be exerted thereon and maintained for this purpose and for purposes of causing the mass of chips to move along the delivery conduit and to enter into the mass of molten metal at the exit port of said delivery conduit below the surface of the mass of molten metal. With the employment of such conditions, especially of the compacted chips being in the form of a densified mass, much less expensive equipment can be utilized for the compaction-extrusion aspect of the process since the compactor-extruder can be provided in the form of a helical screw-compacting extruder with little if any sacrifice of the high performance advantages attained according to the prior art with much more expensive equipment, and with the further advantage that, when operating according to the method and utilizing apparatus of the present invention, the densified mass of chips having the prescribed density is being virtually exploded beneath the surface of the molten metal mass in the form of disbursed or dissociated chips which readily and substantially immediately melt into the mass of molten metal into which introduced. An additional aspect of the invention includes the introduction of an inert gas into the compacted chips to eliminate oxygen and oxidation thereof as they are subjected to pressure to cause them to move as a densified mass along the delivery conduit and into the mass of molten metal at the exit port thereof. A further advantageous aspect of the present invention permits the introduction of the delivery conduit into a mass of molten metal or the removal therefrom by the employment of suitable introduction and removal means, preferably but not necessarily in the form of a pivot arrangement whereby the entire chip charging apparatus may be pivoted for location of the delivery conduit out of contact with the mass of molten metal or dipping thereinto with its exit port below the surface thereof. By the provision of suitable sensors, probes, and thermocouples, the entire operation is rendered fail-safe so that, if the temperature adjacent the exit port of the delivery conduit in the mass of molten metal falls below a predetermined minimum, the delivery conduit or the entire chip-charging apparatus may be pivoted or otherwise elevated out of contact with the mass of molten metal so that the mass of molten metal does not freeze in or around the said delivery conduit exit port. Additionally, the method and apparatus may advantageously be so conducted and arranged that, whenever feed of chips along the delivery conduit and into the mass of moltent metal is desired to be discontinued, the delivery conduit is first elevated out of contact with the molten metal bath, so that the molten metal does not substantially enter into the delivery conduit, and feed of chips only then discontinued. As additional aspects of the invention, the commencement of the operation and discontinuance thereof can be made dependent upon the sensing of an adequate or conversely inadequate supply of chips in chip supply means, additional metal chips from a chip source can be ordered by sensor means in the supply means once the chip level therein has fallen below a predetermined minimum and, all in all, very substantial improvement and advantage over any known prior art method or apparatus are effected by the employment of the method and apparatus of the present invention, as will be immediately apparent to one skilled in the art.

DESCRIPTION OF THE DRAWINGS

A more complete understanding of the invention may be had by reference to the following detailed description when taken in conjunction with the accompanying drawings, wherein.

DETAILED DESCRIPTION OF THE INVENTION

Figure 1:
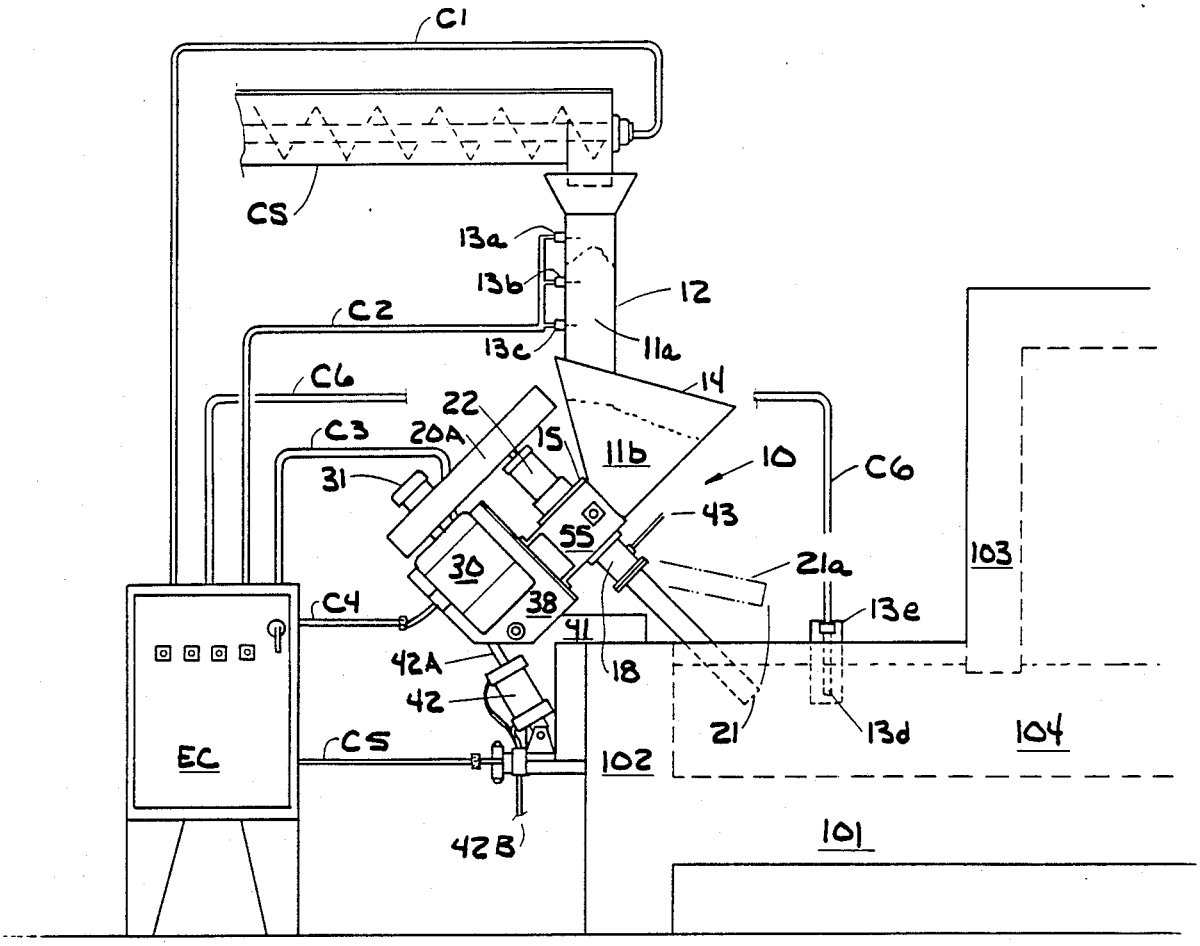
FIG. 1 is a partially schematic side elevational view of a metal chip furnace charging unit and assembly of the invention in charging position, showing the same mounted at one end of a furnace well having a molten metal bath therein and with the charge unit delivery conduit dipping into the mass of molten metal.
Figure 3:
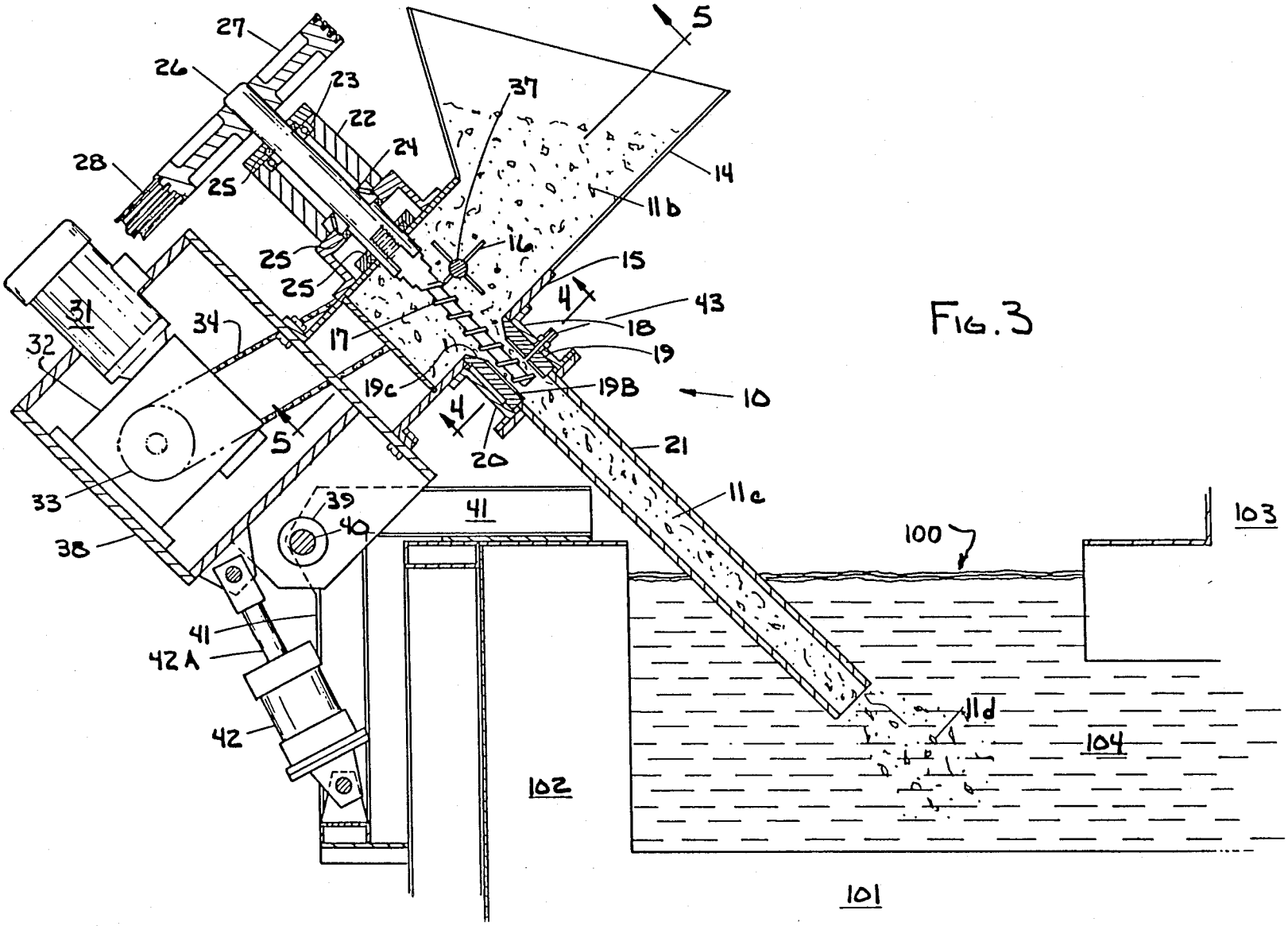
FIG. 3 is a partially schematic and partially cross-sectional side elevational view, with the view thereof along the line 3—3 of FIG. 2 in enlarged cross-section.

Referring now to the drawings, and particularly to FIGS. 1 and 3 thereof:

A conventional reverberatory furnace well is shown generally at 100, comprising bottom wall 101 and side walls 102 and 103, with a mass of molten metal, preferably and usually aluminum, therein being shown at 104.

Mounted on side wall 102 of the furnace well is the metal chip furnace charge unit of the invention, shown generally at 10. Starting metal chips 11*a* brought from chip source CS, shown in the form of an infeed conveyor, the drive mechanism of which is connected to electrical controls EC by circuitry C1, are present in chip charger supply means comprising infeed chute 12, associated with infeed hopper 14 and leading into infeed or charge box 15. Starting metal chips 11*a* therein are sensed (or not sensed—13*c*) in the infeed chute by sensors 13*a*, 13*b*, and 13*c*, respectively for stop chip feed delivery, commence chip feed delivery and/or proceed with furnace charge, and for stop furnace charger operations and remove delivery conduit (21) from furnace well, all connected with electrical controls EC by circuitry C2, which controls are in turn connected to actuatable elements of the apparatus and system by circuitry C3, C4, and C5, as will be more fully explained hereinafter. In molten metal mass 104 adjacent the exit port of delivery conduit 21 is located a further sensor in the form of thermocouple 13*d* encapsulated in liquid-tight graphite tube 13*e* connected with electrical controls EC by circuitry C6.

Incoming chips 11*a* proceed from the infeed chute 12 into hopper 14 where they reside as loosely-packed chips 11*b*. During the process of the invention, these chips become compacted chips 11*c* and then finally, upon eruption below the surface of the mass of molten metal 104 in the furnace, they become uncompacted chips 11*d*, again as will be explained further hereinafter.

Further elements of charge unit 10 which are visible in FIGS. 1 and 3 include bearing housing 22, motor 30 for the screw auger drive unit, base 38, support stand 41, pivot sleeve 39 mounted on base 38, pivot shaft 40 mounted on support stand 41, and pivot actuating pneumatic or hydraulic cylinder 42 and its associated air or other fluid inlet 42B and shaft 42A between support stand 41 and base 38 for pivoting the charge unit 10 about its pivot point 39/40 to cause dipping of delivery conduit 21, which is constructed of material which is resistant to the mass of molten metal under the temperature and other conditions present therein, such as graphite, silica, silicon carbide, or ceramic, and which may illustratively have an I.D. (internal diameter) of 2 to 5 inches and which representatively has an I.D. of 3 inches and is 3 feet in length, into molten metal bath 104 or removal therefrom as shown in shadow lines at 21*a*. Ahead of delivery conduit 21 is die holder 18 for holding a replaceable die 19, to be described further hereinafter and, on the opposite side, inert gas injection port 43 is visible. The compactor and extruder mechanism is present at 55, just below the charge box 15. Motor 30 and bearing housing 22 are as shown connected by drive cover 20A.

Actuating cylinder 42 is pneumatically or hydraulically operated with fluid through fluid inlet 42B from a source not shown and screw auger drive motor 30, as well as feeder motor 31, are electrically powered from sorces not shown but controlled by electrical controls EC via circuitry C4 and C3, respectively.

Figure 2:
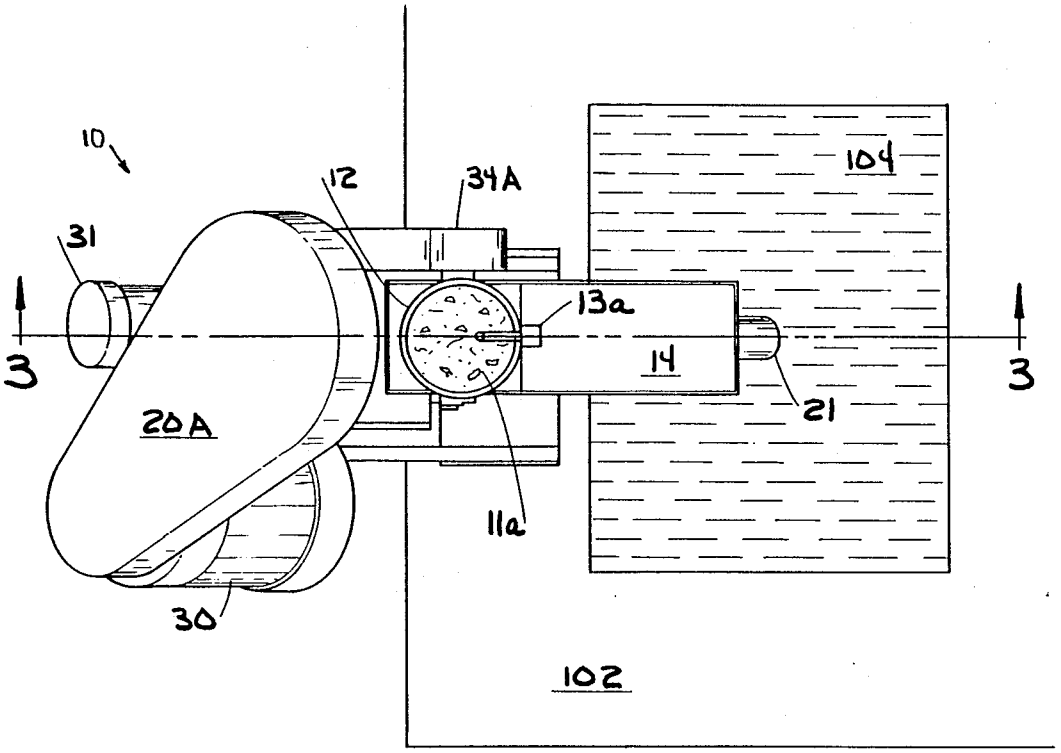
FIG. 2 is a top view thereof.

In FIG. 2 the furnace walls 102, defining the furnace charge well with the mass of molten metal 104 therein, are visible with the chip-charging apparatus 10 mounted upon wall 102, infeed chute 12 with incoming chips 11*a* therein, as well as infeed hopper 14, a portion of the delivery conduit extending over the furnace well containing the mass of molten metal 104 with its usual metal oxide top skin, screw auger drive motor 30, feeder dirve motor 31, drive covers 20A and 34A, and sensor 31*a*.

In the cross section of FIG. 3, taken along line 3—3 of FIG. 2, can be seen the interior elements of the chip-charging apparatus 10 of the invention in enlarged detail. In this FIG. 3, the chip charger device 10 of the invention is shown with delivery conduit 21 introduced into the metal bath, i.e., the charger is pivoted so as to locate the delivery conduit 21 in a position dipping below the metal oxide skin floating on the top surface of the molten metal bath 104, rather than withdrawn therefrom (or pivoted out of contact therewith) as shown in shadow lines at 21*a* in FIG. 1.

As pointed out with regard to FIG. 1, the delivery conduit 21 and the entire chip charger unit 10, for that matter, may be pivoted to take conduit 21 out of contact with the mass of molten metal 104 when desired and under preselected circumstances, which will be further detailed hereinafter, but the delivery conduit 21 means may be raised, retracted, or otherwise elevated out of contact with the mass of molten metal 104 and alternately lowered therein by various means including a hoist, a retractable delivery conduit, an elevator of appropriate size, or the like, although it is to be understood that the pivot means illustrated in the drawings and otherwise referred to and discussed herein is the preferred means of elevating and lowering delivery conduit 21 into the mass of molten metal 104, which is, according to the present invention, preferably effected by pivoting the same along with the entire charger combination or assembly 10 for these purposes as well as for the overriding purposes of commencing or discontinuing a particular chip-charging operation.

As shown in FIG. 3, loosely-packed chips 11*b* proceed in infeed hopper 14 and are fed into infeed or charge box 15 by feeder fingers 16 mounted on feeder shaft 37 driven by chain 34 carried on driven sprocket 36 (See FIG. 5) and drive sprocket 33 controlled by gear reducer 32 in turn driven by feeder drive motor 31, the gear reducer 32 being mounted within base 38 and motor 31 extending from base 38 and being supported thereby.

As loosely-packed chips 11*b* are propelled by rotating feeder fingers 16 into contact with feed screw auger 17, they are further compacted and extruded into delivery conduit 21 in the form of a densified mass comprising the compacted chips 11*c* which substantially fill the delivery conduit 21 and are caused to move therealong by the force imparted by the compaction/extrusion means 55 until they burst from the open end thereof beneath the surface of molten metal mass 104 as dispersed and dissipated chips 11*d*. Conduit 21 has its opposite end communicating with the compactor and extruder section of the chip charger apparatus 10, which includes venturi 19C leading into replaceable die 19 in the form of a rifled barrel-like insert which is held by die holder 18 along with key 20 for keying the die and die holder elements together, and including inert gas injector port 43 for the injection of inert gas into the mass of compacted chips 11*c* for the elimination of oxygen therefrom and for the prevention of oxidation during the compacting and extrusion step of the operation and especially during travel of chips 11*c* along conduit 21 into molten metal mass 104.

Feed screw auger 17 is mounted in driven shaft 26 associated with driven sheave 27 which is driven by belts 28 connecting with a sheave or pulley (not shown) provided on the shaft of screw aueer drive motor 30 beneath drive cover 20A as shown in FIG. 1. Driven shaft 26 is mounted in bearing housing 22 and supported therein for rotation by tapered roller bearings 24 and ball bearings 23 sealed in said bearing housing 22 by seals 25, said bearing housing 22 as shown being affixed by welding or the like to infeed or charge box 15.

Figure 4:
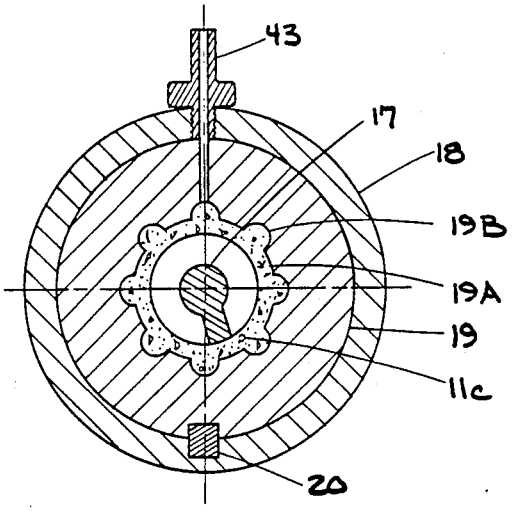
FIG. 4 is a cross-sectional view taken along the line 4—4 of FIG. 3.

FIG. 4 is a cross-sectional view taken along the line 4—4 of FIG. 3 and shows in enlarged detail the inert gas injector port 43 along with key 20, keying replaceable die 19 into die holder 18. Replaceable die 19, constructed of stress-proof metal such as heat-treated steel, high magnesium steel, or the like, has an orifice 19A comprising rifling or rifled lining 19B through which the compacted chips 11*c* are forced under pressure by rotation of the feed screw auger 17.

Figure 5:
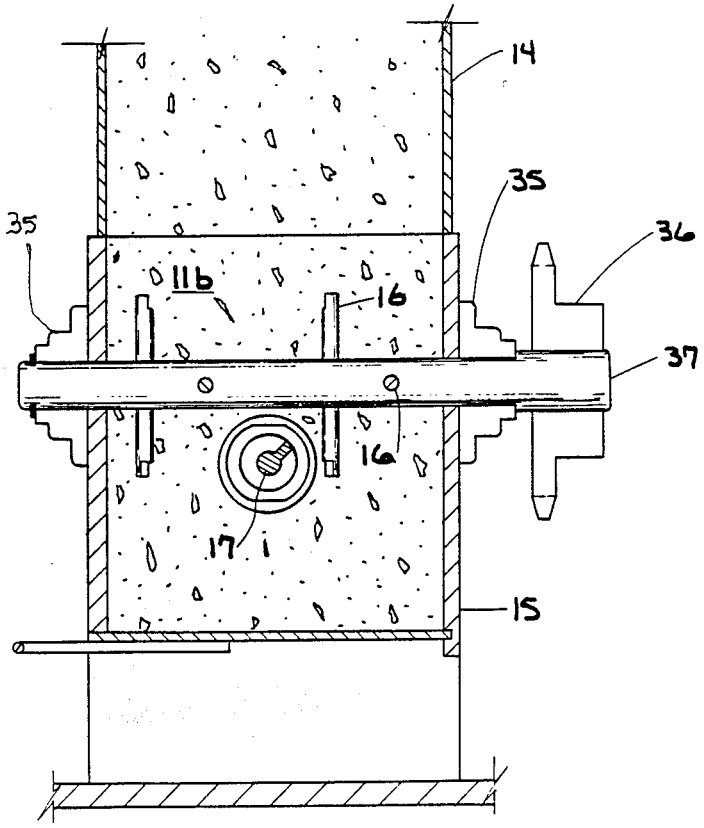
FIG. 5 is a cross-sectional view taken along the line 5—5 of FIG. 3.

In FIG. 5 is shown a cross section taken along line 5—5 in FIG. 3, from which a portion of infeed hopper 14, infeed or charge box 15, and feed screw auger 17 are visible. Feeder fingers 16 located upon feeder shaft 37 keyed to driven sprocket 36 and mounted for rotation in bearings 35 are also visible. It will be apparent that driven sprocket 36 is driven by chain or belt 34 and drive sprocket 33 as shown in FIG. 3.

With respect to sensors 13*a*, 13*b*, 13*c* and 13*d*, and their connections with the electrical controls EC by means of conduitry C2 and C6, as well as connection of chip source CS with electrical controls EC by means of conduitry C1, which electrical controls are in turn associated with feeder drive motor 31, screw auger drive motor 30, and pivot actuating cylinder 42, respectively by conduitry C3, C4, and C5, these may be connected in usual manner with switches and/or rheostats for commencing or discontinuing feed into the charge well or otherwise or for varying the rate of feed into the charge well or otherwise, depending upon the supply of chips sensed, and depending upon the temperature sensed in the mass of molten metal in the charge well (when the feed is into the charge well), the associated controls for such functions not being illustrated in the drawings, but being present in the electrical controls EC provided in the system. Aside from an override on and off switch on the electrical control box, or an "elevate" and "lower" switch with respect to the delivery conduit 21, and other overriding controls which might be desired, the apparatus of the invention operates in accord with the method of the invention or can be made to so operate almost entirely automatically by means of the various sensors employed and their association mainly with start-stop sequences as will be even more fully described hereinafter.

OPERATION

In operation, starting chips are brought from a chip source CS, as shown in the form of an infeed conveyor, and are introduced into infeed chute 12 until sensor 13*a* toward the top of chute 12 is reached, whereupon the electrical controls and associated circuitry C1 and C2 stop chip feed delivery from chip source CS, here illustrated as an infeed conveyor. When the supply of chips in the infeed chute 12 reaches sensor 13*b*, a commence chip delivery switch may be thrown, whereupon chip feed delivery commences once more from chip source CS. Sensor 13*b* may also instigate a "proceed with charge" command, with activation of the electrical controls via circuitry C2, C3, C4, and C5, whereby the charge unit 10 can be pivoted into position with its delivery conduit 21 dipping under the surface of molten metal pool 104, preferably just *after* feeder powder and auger power have been simultaneously imparted to auger drive motor 30 and feeder drive motor 31 for commencement of the compacting-extruding and feeding operation into delivery conduit 21. When the charge of starting chips drops down below sensor 13*c* in chute 12, the reverse order of switches is thrown and the chip charger unit 10 pivoted so that its delivery conduit 21 no longer dips beneath the surface of the molten metal mass 104 but is removed therefrom as shown in shadow lines in FIG. 1 *whereafter* the operation is stopped.

As already stated, override buttons can be employed for various functions but, as will be clear from the foregoing, the operation can be made semi-automatic or completely automatic on a continuous basis if desired.

Sensor 13*d* encapsulated in liquid-tight graphite protective tube 13*e* is shown disposed beneath the surface of the mass of molten metal 104 in the charge well and may representatively be a Honeywell Dialatrol TM or Electronic 15 TM or Barber-Coleman equivalent Model 560 TM thermocouple, for sensing the temperature adjacent to the exit port of delivery conduit 21. Should the temperature of the molten metal pool 104 in the charge well drop below a certain predetermined level, the rate of feed of new or used unmelted starting metal chips into the charge well via delivery conduit 21 may be reduced or feed stopped completely until the temperature again reaches a favorable predetermined higher level to accommodate further feed and immediate dissolution of the dissipated chips 11*d* into the main mass of molten metal 104.

Within the chip charger 10 compaction is effected by means of rotation of feeder fingers 16 on feeder shaft 37 and extrusion is effected by means of feed screw auger 17 whereby the loosely-packed chips 11*b* are compacted and then extruded, simultaneously with injection of inert gas such as nitrogen through inert gas injection port 43, into delivery conduit 21 in the form of a densified mass comprising compacted and extruded chips 11*c* which substantially fill the delivery conduit 21 and are caused to move therealong by the compaction-extrusion force until they burst from the open end of the delivery conduit 21 beneath the surface of the molten mass as dissipated chips 11*d* at which point they rapidly dissolve into the mass of molten metal 104 with a minimum of oxidation and delay and with an extremely high degree of utilization efficiency.

The compactor-extruder 55 with its component parts as just described operates to compact and extrude the loosely-packed chips 11*b* into compacted chips 11*c* and thence through die holder 18 holding replaceable die 19 which has an orifice 19A comprising rifling 19B through which the thus-compacted chips 11*c* are forced under pressure by rotation of the feed screw auger 17 in the form of compacted chips 11*c* which substantially fill delivery conduit 21 and which move along delivery conduit 21 in the form of a densified mass until the chips burst from the submerged end of delivery conduit 21 into the mass of molten metal 104 where they are substantially immediately dissolved into and become a part of the molten metal mass 104 itself.

The metal chips and especially aluminum chips have a density of approximately 15 to 20 pounds per cubic foot before compacting and a greater density, e.g., approximately 68 or so pounds per cubic foot, after compacting, with the range being between about 55 and 80 pounds per cubic foot at least during the time the compacted chips 11*c* are proceeding along delivery conduit 21 into the molten metal mass 104. The preferred rage of density of the compacted chips is 65–70 pounds per cubic foot. Alternatively stated, the density of the mass of chips 11*c* is preferably maintained between about 30 and 60 percent of the density of the solid metal involved, especially when the metal is aluminum, with the optimum range being between about 40 and about 50 percent of the density of the solid metal, and the optimum being at approximately 42 percent of the density of the solid metal itself. Too little is not recommended as operative or safe and much more requires greater compaction-extrusion pressure and more elaborate equipment. This limited densification assists in an improved melting of the chips and results in a more rapid melt rate, maintaining an equally satisfactory reduction in melt loss as in my earlier patent, but moreover permits employment of considerably less compaction and extrusion pressure and consequently also much less expensive equipment.

Another advantage of the densification of the chips to such a limited extent (but not to the extent of a completely solid rope or chain of briquettes as disclosed in my earlier patent), is that the densification reduces the air space and entrained oxygen which is introduced into the molten metal bath and thereby eliminates or substantially reduces the oxidation of the chips before and at the time of entering the molten metal bath, thereby reducing or substantially eliminating the formation of oxides in the molten metal with its attendant loss to oxide, while simultaneously attaining a much more rapid dissolution rate. A further adjunctive advantage is that in the present method and apparatus there is provided the possibility of adding an inert gas such as nitrogen to displace the oxygen ordinarily entrained in chips, with still further advantageous oxide elimination.

Therefore, as the metal chips 11*c* fill the delivery conduit 21, they do not compact to the same high degree as a solid briquette or solid rope, being only in compacted or densified condition, but they created a plug in the conduit 21 which eventually becomes a full-length plug so that molten metal from the bath 104 does not enter the conduit, which would effect premature melting of chips within the conduit, thereby causing it and the chip-charging apparatus to jam, as it is just as possible for the molten metal to freeze up in the conduit, which is at a temperature lower than the melt temperature, as it is for the melt itself to freeze up because of the maintenance of an inadequately high temperature therein. Chip charging according to the invention should therefore be and preferably is operated on a continuous or at least semi-continuous basis to avoid freezing up which might involve an initial premature melting within the delivery conduit, especially due to entry of molten metal thereinto. The operation therefore commences with the delivery conduit out of the molten metal bath, the charge of compacted chips 11*c* into the conduit is begun along with introduction of inert gas such as nitrogen, the plug is created, the conduit is filled with the mass of compacted chips 11*c*, and then the chip-charger apparatus 10 of the invention is lowered so that its delivery conduit 21 dips into the molten metal bath, whereupon the operation runs continuously with continuous feed to keep the delivery conduit 21 full until it is desired to discontinue the operation, at which time the delivery conduit 21 and/or the entire chip-charging apparatus 10 is elevated, pivoted, or otherwise removed from the mass of molten metal 104 before discontinuing feed of compacted chips 11c within the delivery conduit 21.

As pointed out in the foregoing, at any point at which a sensor or other control, including manual control, switches the operation to proceed, the sequence should be: *first* feed until the delivery conduit is full of compacted chips and *only then* pivot or otherwise lower the delivery conduit into the mass of molten metal, and thereafter continuously feed until it is desired to discontinue or until a sensor determines that discontinuance is in order, at which time the sequence is: *first* elevate and *thereafter* discontinue feed, since the reverse is fraught with the possibility that discontinuance of feed prior to elevation, pivoting, or other removal of the delivery conduit from the mass of molten metal may enable molten metal to enter into the delivery conduit and freeze up therein with its attendant serious problems, as will be apparent to one skilled in the art.

IN GENERAL

The method and apparatus of the present invention is particularly adapted for use in connection with nonmagnetic metal scrap such as brass, aluminum, aluminum alloys, and the like, and such nonmagnetic metal scrap may conveniently be separated from a mass of metal scrap including also ferrous, ferric, or other magnetic chips by the employment of magnetic separation means, as is now well known and established in the art.

Although, in referring to the foregoing detailed description of the invention and to the drawings, reference is made to the employment of a thermocouple or sensor for sensing the temperature in or in close juxtaposition to the molten metal in the charge well of the reverberatory furnace, which may be connected through a potentiometer or the like to an on-off switch or rheostat, for controlling the introduction or speed of introduction of compacted chips into the charge well, it should be clear that any equivalent electrical and/or mechanical arrangement may be employed whereby, when the temperature sensed in the charge well, or otherwise at or near the point of introduction of fresh metal (either used or new, but in any event to be melted) into a molten metal bath, reaches a level which is considered sufficiently low to represent a potential danger in the form of excessive crystallization or solidification (due to a temperature drop to below that required for rapid melting of new metal in the vicinity of the new metal introduction), the rate of introduction of new metal into the molten metal bath is diminished or discontinued until the temperature can rebound to a safe level, whether this be by reducing the rate of operation of the compactor-extruder and/or the feed into the same or by completely switching off one or the other or both of such means, and/or by retracting, pivoting, or otherwise elevating the delivery contuit and/or the entire chip-charging apparatus so as to take the delivery conduit out of the molten metal bath, all until an adequate temperature is again sensed in or near the point of new metal introduction into the molten metal bath so that the previously-existing potential problem is no longer of concern.

Whereas, in this Specification and claims, reference is frequently made to "metal chips", this is to be understood as encompassing metal chips of various almost unlimited proportions, configurations, and dimensions, but particularly to include small pieces and/or particles, likewise of extremely variable dimensions, and in general the term "metal chips" is employed herein as having the usual meaning to one skilled in the art, being inclusive not only of parts, pieces, particles, and fragments of the usual type from scrap, but also previously-unused metal in standard or odd configurations remaining from previous molding, extruding, casting, rolling, or like metal processing operations, and it goes without saying that inconveniently large pieces can be reduced in size in any convenient manner and employed as metal chips and that, accordingly, any suitable metal, whether scrap or otherwise, can be converted into chips and employed in the method and apparatus of the invention, whether new metal or previously used metal, including even and especially new and used aluminum sheet and can scrap, when it is determined that such further processing into new metal is required or desired by the operator.

It is thereby seen from the foregoing that the objects of the present invention have been accomplished and that a novel, efficient, improved, and economic method for the introduction of metal chips into a molten mass of the metal of which said chips are formed, involving compacting and extruding said metal chips and then introducing the compacted metal chips into the molten metal bath in the form of a densified mass, preferably having certain defined density characteristics, which dissociates or disperses upon "exploding" from the exit port of a delivery conduit at a point beneath the surface of the molten metal bath, all in accord with the foregoing, has been provided thereby, as well as apparatus for use in carrying out the said method, and whereby all of the previously-mentioned advantages have been attained and the shortcomings of the prior art have been obviated.

Although the preferred embodiments of the invention have been illustrated in the accompanying drawings and described in the foregoing description, it is to be understood that the invention is not limited to the embodiments disclosed or to the exact details of operation or exact compounds, compositions, methods, or procedures shown and described, since the invention is capable of numerous modifications, rearrangements, and substitutions of parts and elements and other equivalents, whether metallurgical, chemical, electrical, or mechanical, without departing from the spirit or scope of the invention, as will readily be apparent to one skilled in the art, wherefore the present invention is to be understood as limited only by the full scope which can be legally accorded the appended claims.

I claim:

1. A method for the industrial utilization of metal chips which involves the introduction of said metal chips into a mass of molten metal of which said chips are formed, comprising the steps of:

providing a delivery conduit of a material which is resistant to the mass of molten metal, under the temperature and other conditions present therein, compacting and extruding said metal chips into said delivery conduit in the form of a densified mass, creating a pressure upon the densified mass of chips in the delivery conduit, causing the densified mass of chips in the delivery conduit to substantially fill said delivery conduit and to move along said delivery conduit, causing said delivery conduit to dip into said mass of molten metal so as to provide a point of introduction below the surface thereof, causing the densified mass of chips within the delivery conduit to exit from said delivery conduit directly into said mass of molten metal at said point of introduction below the surface thereof, and maintaining a pressure upon the densified mass of chips within the delivery conduit sufficient to prevent substantial entry of the mass of molten metal into said delivery conduit.

2. Method of claim 1 which is conducted on a continuous basis.

3. Method of claim 1 which is conducted on a semi-continuous or batchwise basis.

4. Method of claim 1 wherein said delivery conduit is elevated out of said mass of molten metal when it is desired to discontinue the introduction of chips thereinto.

5. Method of claim 4 wherein said delivery conduit is alternately dipped into and removed from said mass of molten metal.

6. Method of claim 1 comprising the step of alternately pivoting the delivery conduit to a position dipping into said mass of molten metal and to a position removed from said mass of molten metal.

7. Method of claim 1 wherein the process is carried out on a continuous basis until it is desired to discontinue introduction of the densified mass of chips into the molten mass of metal, whereupon said delivery conduit is elevated out of a position dipping into said mass of molten metal and the pressure upon the densified mass of chips in the delivery conduit is reduced or discontinued.

8. Method of claim 1, including the step of providing supply means for chips ahead of said compaction and extrusion steps and sensing the presence of starting chips in said supply means and discontinuing the introduction of the densified mass of chips into the molten mass of metal when the quantity of starting chips fall below a predetermined minimum.

9. Method of claim 8 wherein, as a part of said discontinuance, said delivery conduit is pivoted to a position removed from said mass of molten metal.

10. Method of claim 1, including the step of providing supply means ahead of said compaction and extrusion steps and sensing the presence of starting chips in said supply means and commencing the introduction of the densified mass of chips into the molten metal when the quantity of starting chips is above a predetermined minimum.

11. Method of claim 4, wherein, as a part of the discontinuance of said introduction, the delivery conduit is pivoted from a position dipping into said mass of molten metal to a position removed from said mass of molten metal.

12. Method of claim 1, wherein the chips are compacted to a point within the range of approximately 55 to 80 pounds per cubic foot during the extrusion process.

13. Method of claim 12, wherein the chips are compacted to approximately 65–70 pounds per cubic foot during the extrusion process.

14. Method of claim 1, wherein the density of the densified mass of chips within the delivery conduit is maintained between about 30 and 60 percent of the density of the solid metal.

15. Method of claim 14, wherein the density of the densified mass of chips within the delivery conduit is maintained between about 40 and 50 percent of the density of the solid metal.

16. Method of claim 15, wherein the density of the densified mass of chips within the delivery conduit is maintained at approximately 42 percent of the density of the solid metal.

17. Method of claim 1, wherein the starting material comprises aluminum chips and the bath of molten metal is molten aluminum.

18. Method of claim 12, wherein the starting material comprises aluminum chips and the bath of molten metal is molten aluminum.

19. Method of claim 14, wherein the starting material comprises aluminum chips and the bath of molten metal is molten aluminum.

20. Method of claim 15, wherein the starting material comprises aluminum chips and the bath of molten metal is molten aluminum.

21. Method of claim 1, wherein an inert gas is introduced into the delivery conduit along with the densified mass of chips for the displacement of oxygen therein.

22. Method of claim 12, wherein an inert gas is introduced into the delivery conduit along with the densified mass of chips for the displacement of oxygen therein.

23. Method of claim 4, wherein said delivery, conduit is removed from the mass of molten metal before discontinuing feed of the densified mass of chips to said delivery conduit.

24. Method of claim 1, including the step of sensing the presence of starting metal chips in supply means located ahead of said compaction and extrusion steps and discontinuing delivery of starting metal chips to said supply means when the quantity of metal chips therein exceeds a predetermined maximum.

25. An apparatus for the introduction of metal chips into a mass of molten metal of which said chips are formed, the combination comprising:

compactor and extruder means for compaction and extrusion of compacted metal chips into a delivery conduit in the form of a densified mass, a delivery conduit of material resistant to the mass of molten metal under the temperature and other conditions present thereinto, wherein said delivery conduit has one open end for communicating with said mass of molten metal and an opposite open end in communication with said extruder means, means for providing a pressure upon the densified mass of chips within said delivery conduit, and for moving said densified mass of chips along said delivery conduit, and out of said one open end thereof and into said mass of molten metal when said delivery conduit is positioned so as to dip below the surface of said mass of molten metal.

26. The combination of claim 25, comprising a metal chip charge box for introduction of starting metal chips into said compactor and extruder means.

27. The combination of claim 26, including hopper means associated with said charge box for delivery of starting metal chips thereinto.

28. The combination of claim 25, comprising elevating and lowering means for lowering said delivery conduit into a position dipping into said mass of molten metal and elevating said delivery conduit into a position removed from said mass of molten metal.

29. The combination of claim 25, wherein the means operating both to extrude said chips in the form of a densified mass into said delivery conduit and to provide pressure upon the densified mass of chips in said delivery conduit is a compactor-extruder.

30. The combination of claim 29, wherein said compactor and extruder means is a screw-compacting extruder.

31. The combination of claim 25, including supply means for bringing said starting metal chips to the compactor and extruder.

32. The combination of claim 31, including sensing means associated with said supply means for discontinuing feed of the densified mass of chips into said molten metal mass when the supply of starting metal chips fall below a predetermined minimum.

33. The combination of claim 32, including elevating means for elevating said delivery conduit out of said molten metal bath and wherein said sensing means is also associated with said elevating means.

34. The combination of claim 25, including metal chip supply means for bringing metal chips to the extruder and compactor and sensing means for discontinuing supply of metal chips when the quantity of starting metal chips in said supply means is above a predetermined maximum.

35. The combination of claim 25, including metal chip supply means for bringing metal chips to the extruder and compactor and pivot means and sensing means for pivoting said delivery conduit out of contact with said molten metal bath when the quantity of metal chips in said supply means falls below a predetermined minimum.

36. The combination of claim 25, including means for the introduction of an inert gas into said delivery conduit along with the densified mass of chips.

37. The combination of claim 28, including means for the introduction of an inert gas into said delivery conduit along with the densified mass of chips.

38. The combination of claim 25, including elevating and lowering means for elevating and lowering said delivery conduit into contact with and out of contact with said mass of molten metal and sensing means for sensing the supply of starting metal chips and initiating feed of chips to said compactor and extruder and into said delivery conduit when said supply of starting chips is above a predetermined minimum but for elevating said delivery conduit out of contact with said molten metal bath and discontinuing feed when said supply of starting metal chips falls below a predetermined minimum.

39. The combination of claim 38, comprising sensing means for sensing a minimum supply of starting metal chips located ahead of said compactor and extruder and for removing the delivery conduit from the molten metal bath when the supply of starting metal chips falls below such a minimum.

40. The combination of claim 38, including means for pivoting said delivery conduit into and out of contact with said molten metal bath, and sensing means for pivoting said delivery conduit out of contact with said molten metal bath before discontinuing feed of starting metal chips to said compactor and extruder means, and means for sensing the minimum supply of starting chips below which feed is discontinued.

41. An apparatus for the introduction of metal chips into a mass of molten metal of which said chips are formed, the combination comprising:

compactor and extruder means for compaction and extrusion of compacted metal chips into said delivery conduit in the form of a densified mass, a delivery conduit of material resistant to the mass of molten metal under the temperature and other conditions present therein, wherein said delivery conduit has one open end for communicating with said mass of molten metal and an opposite open end in communication with said extruder means, means for providing a pressure upon the densified mass of chips within said delivery conduit, and for moving said densified mass of chips along said delivery conduit, and out of said one open end thereof and into said mass of molten metal when said delivery conduit is positioned so as to dip below the surface of said mass of molten metal, and pivot means for pivoting said combination into a position in which said delivery conduit is dipping into said mass of molten metal and into a position wherein said delivery conduit is removed from said mass of molten metal.

42. The combination of claim 41, comprising a metal chip charge box for introduction of starting metal chips into said compactor and extruder means, and wherein said charge box pivots along with said combination.

43. The combination of claim 42, including hopper means associated with said charge box for delivery of starting metal chips thereinto and wherein said hopper pivots along with said charge box.

44. Method of claim 1 including the step of coordinating the rate of feed of said compacted chips into said mass of molten metal with the temperature in said mass of molten metal at or near the point of introduction of said compacted metal chips thereinto.

45. Method of claim 1, wherein the rate of introduction of said compacted chips into said mass of molten metal is reduced or stopped when said temperature in said molten metal mass at or near said point of introduction falls below a predetermined temperature.

46. The combination of claim 25, comprising sensing means for sensing the temperature in a mass of molten metal and control means for coordinating the rate of exit of said compacted metal chips from said delivery conduit with the temperature sensed in said molten metal mass.

47. The combination of claim 46, wherein said sensing means comprises a thermocouple.

48. The combination of claim 25, comprising sensing means for sensing the temperature in a mass of molten metal and control means for removing said delivery conduit from or lowering said delivery conduit into said mass of molten metal depending upon the temperature sensed in said molten metal mass.

49. The combination of claim 48, wherein said sensing means comprises a thermocouple.

* * * * *

UNITED STATES PATENT AND TRADEMARK OFFICE

CERTIFICATE OF CORRECTION

PATENT NO. : 4,872,907

DATED : October 10, 1989

INVENTOR(S) : Larry D. Areaux

It is certified that error appears in the above-identified patent and that said Letters Patent is hereby corrected as shown below:

Col. 2, line 21; insert -- , -- after "metal"

Col. 2, line 23; "to" should read -- the --

Col. 5, line 52; "mass" should read -- metal --

Col. 6, line 23; "then" should read -- than --

Col. 8, line 63; "sorces" should read -- sources --

Col. 9, line 5; "dirve" should read -- drive --

Col. 9, line 6; "31a" should read -- 13a --

Col. 10, line 4; "aueer" should read -- auger --

Col. 11, line 4; "powder" should read -- power --

Col. 12, line 4; "rage" should read -- range --

Col. 12, line 42; "created" should read -- create --

Col. 13, line 57; "contuit" should read -- conduit --

Col. 15, line 37; "fall" should read -- falls --

Col. 16, line 41; "thereinto" should read -- therein --

Signed and Sealed this

Twenty-eighth Day of August, 1990

*Attest:*

HARRY F. MANBECK, JR.

*Attesting Officer*

*Commissioner of Patents and Trademarks*